US005575397A

United States Patent [19]

Wood

[11] Patent Number: 5,575,397

[45] Date of Patent: Nov. 19, 1996

[54] APPARATUS FOR PROTECTING THE RELIEF VENT ON A DOUBLE-WALLED TANK FOR SURGING LIQUID

[76] Inventor: Donald A. Wood, 2651 S. Cherokee St., Denver, Colo. 80223

[21] Appl. No.: 509,879

[22] Filed: Aug. 1, 1995

[51] Int. Cl.[6] ..... B65D 51/16; B65D 90/34

[52] U.S. Cl. ..... 220/203.01; 137/382; 220/89.1; 220/373; 220/724

[58] Field of Search ..... 220/89.1, 203, 220/208, 373, 374, 580, 582, 586; 137/377, 382

[56] References Cited

U.S. PATENT DOCUMENTS

| | | | |
|---|---|---|---|
| 770,043 | 9/1904 | Bode et al. | 137/382 X |
| 953,052 | 3/1910 | McCarty | 137/382 |
| 967,895 | 8/1910 | Frederick . | |
| 1,459,817 | 6/1923 | Bingay | 220/89.1 |
| 2,028,756 | 1/1936 | Crecca et al. | 137/382 X |
| 2,918,192 | 12/1959 | Dedman . | |
| 3,128,899 | 4/1964 | Runo . | |
| 3,140,006 | 7/1964 | Nelson | 220/586 X |
| 3,381,846 | 5/1968 | Lee | 220/203.04 |
| 4,685,327 | 8/1987 | Sharp | 220/469 X |
| 4,960,222 | 10/1990 | Fields, III | 220/571 |

FOREIGN PATENT DOCUMENTS

| | | | |
|---|---|---|---|
| 1252543 | 12/1960 | France | 220/324 |

*Primary Examiner*—Allan N. Shoap
*Assistant Examiner*—Niki M. Kopsidas
*Attorney, Agent, or Firm*—Dorr, Carson, Sloan & Birney, P.C.

[57] ABSTRACT

A double-walled tank assembly having a passageway from an inner tank to an outer tank, the passageway having an outer opening, and a cover removably mounted over the outer opening of the passageway to seal the passageway. The cover has a pressure relief vent and a plate suspended from the cover, within the passageway, below the pressure relief vent, and above the opening in the inner tank. In the event of liquid surging within the tank, the plate prevents the liquid from impinging against the pressure relief vent. In addition, in order to prevent tampering with the pressure relief vent, the cover has an enclosure around the pressure relief vent to prevent tampering.

12 Claims, 6 Drawing Sheets

Fig. 5
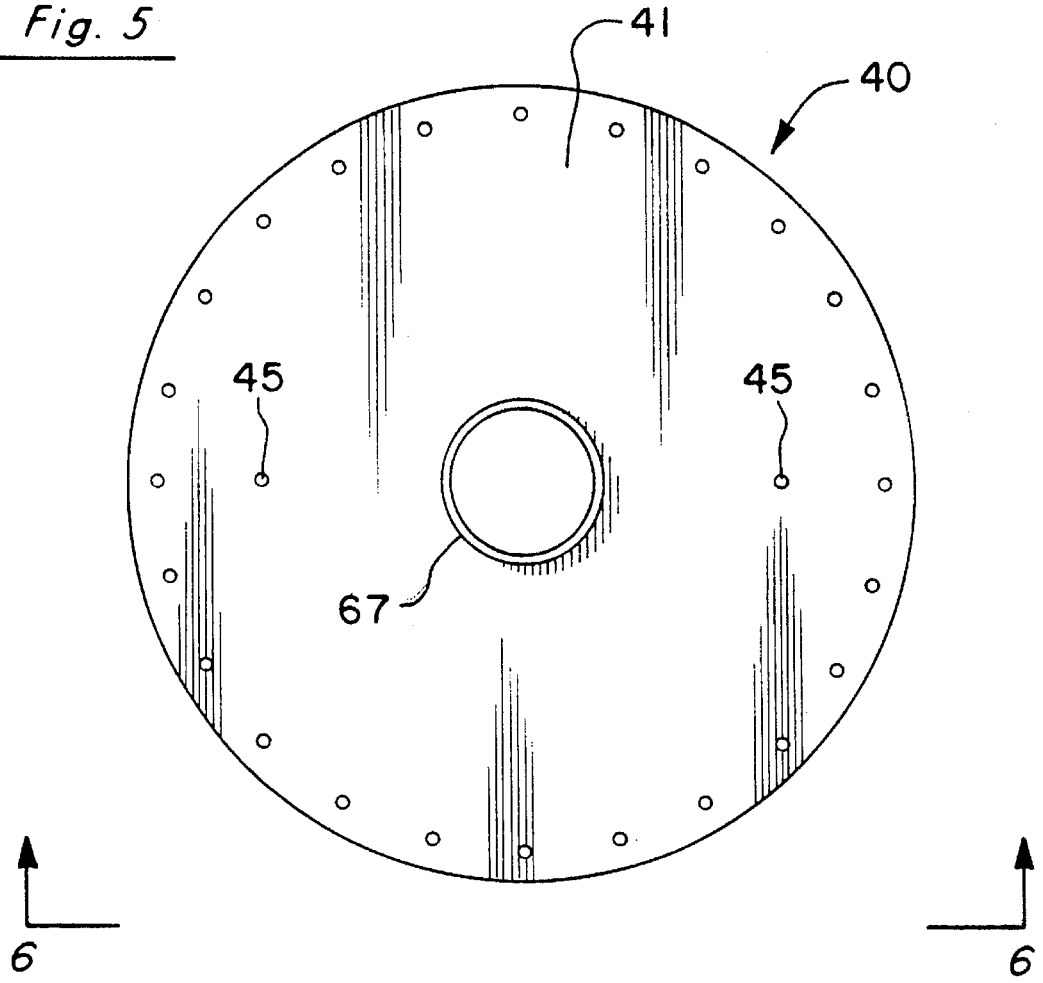
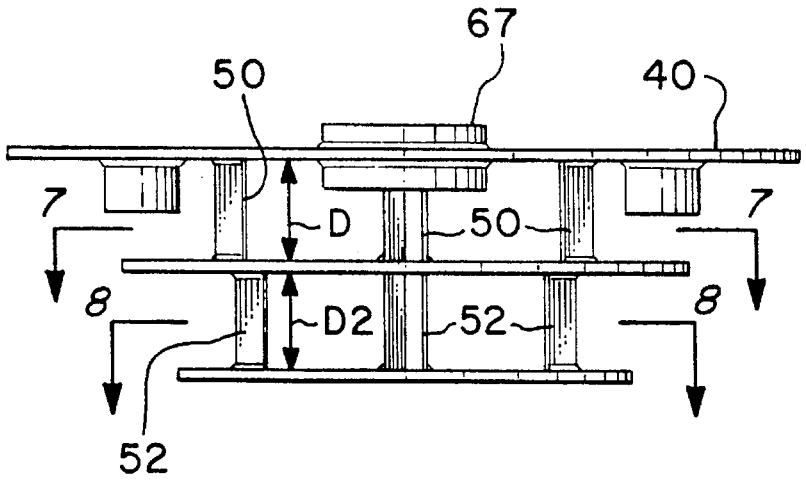
Fig. 6

APPARATUS FOR PROTECTING THE RELIEF VENT ON A DOUBLE-WALLED TANK FOR SURGING LIQUID

BACKGROUND OF THE INVENTION

1. Field of the Invention

The present invention relates generally to the field of double-walled storage tanks, and more specifically, to double-walled storage tanks having a pressure relief vent.

2. Statement of the Problem

Double-walled storage tanks are well known in the art for a wide variety of uses. In recent years, double-walled storage tanks have increasingly been used for above-ground storage of gasoline and other flammable liquids. In order to enhance safety, such double-walled tanks typically have a pressure relief vent to prevent the buildup of an excessive pressure within the tank by venting the interior of the tank to the atmosphere when the internal pressure exceeds a predetermined limit. However, when such tanks are transported on the bed of a flat-bed truck or other vehicle, the liquid within the tank surges due to changes in the relative velocities of the truck and tank with respect to the liquid contained within the tank. The surging liquid can impinge on the pressure relief vent, and the dynamic pressure of the surging liquid can cause the vent to open even though the static pressure within the tank has not reached the predetermined limit. The pressure relief vent typically remains open once triggered. The open vent may not be noticed by the driver of the vehicle for quite some time. While the open vent goes unnoticed, the fluid will continue to surge out of the open vent, creating a particularly dangerous problem in the case of flammable liquids. Therefore, a need exists for an apparatus to prevent the surging liquid within a double-walled tank from causing the pressure relief vent of the tank to open.

A number of devices have been invented in the past to prevent liquids from surging out of passageways to tanks. However, none of these devices were for use on a double-walled tank with a pressure relief vent. These prior art devices include the following:

| Inventor | Patent No. | Issue Date |
|---|---|---|
| Dedman | 2,918,192 | Dec.22, 1959 |
| Runo | 3,128,899 | April 14, 1964 |
| Frederick | 967,895 | April 23, 1910 |

Dedman discloses an anti-splash venting closure for the circular filler neck of a fuel tank for a gasoline powered mower or the like.

Runo discloses a vent for use with fluid storage tanks in which fluid within the tank is drained by means of a suction force applied to a discharge opening in the tank.

Frederick discloses a breather for a crankcase of an engine to relieve pressure, the breather having baffle plates to allow free passage of air but to prevent oil from being splashed out of the crankcase.

3. Solution to the Problem

None of these prior art references show a double-walled storage tank with a pressure relief vent and means between the pressure relief vent and the liquid in the tank to prevent the liquid from impinging against the pressure relief vent. More specifically, none show a cover with a pressure relief vent and a deflection surface mounted to the cover to prevent the fluid from directly impinging against the vent causing it to open. Instead, all of these prior art references concern devices providing a continuous, constantly open path between the external atmosphere and an interior volume. Hence, these devices would not work in conjunction with a passageway sealed by a cover having a pressure relief vent where the passageway was intended to be sealed except when the internal pressure exceeded a predetermined limit, at which limit the pressure relief vent would open to vent the interior volume to the atmosphere surrounding the tank.

The present invention provides a novel, relatively low cost, and rugged solution to the stated problem by providing a double-walled tank having a passageway from an inner tank to an outer tank, the passageway having an outer opening, and a cover removably mounted over the outer opening of the passageway to seal the passageway. The cover has a pressure relief vent and a plate suspended from the cover, within the passageway, below the pressure relief vent, and above the opening in the inner tank. In the event of liquid surging within the tank, the plate prevents the liquid from impinging against the pressure relief vent. In addition, in order to prevent tampering with the pressure relief vent, the cover has an enclosure around the pressure relief vent to prevent tampering.

SUMMARY OF THE INVENTION

This invention provides a double-walled tank assembly having a plate suspended from a cover to prevent surging liquid from impinging directly against a pressure relief vent mounted to the cover. More specifically, the invention provides a tank assembly having an inner tank for storing a liquid, and an outer tank surrounding the inner tank. A passageway extends upward from the opening in the inner tank through the outer tank. The tank assembly also includes a cover mounted over the outer opening of the passageway. A pressure relief vent is mounted to the cover. The pressure relief vent opens when pressure within the inner tank exceeds a predetermined limit. At least one plate is suspended from the cover at a predetermined distance below the pressure relief vent and above the opening of the inner tank so as not to extend into the inner tank. The plate has dimensions sufficiently large so as to prevent the liquid surging within the inner tank from directly impinging upon the pressure relief vent. However, the plate is not so large as to seal the passageway.

In the preferred embodiment, the clearance between the plate and the interior of the passageway is small compared to the overall diameter of the passageway. Also, in the preferred embodiment, two plates are used, the second having a smaller diameter than the first. The first plate is suspended from the cover, and the second plate is suspended from the first plate but above the opening in the inner tank.

In operation, when the tank assembly is carried on a flat-bed truck, for example, and when the flat-bed truck changes direction or speed, the liquid stored within the tank will surge. The surging liquid will, in some instances, flow up the passageway and impinge against the plates. Without the protection of the plates, the dynamic pressure of the surging liquid could cause the pressure relief vent to open.

One type of pressure relief vent frequently used on double-walled tanks is a simple mechanism consisting of a hinged plate covering a port, the plate being held closed by a spring loaded pin designed to open when the pressure on the inside of the tank exceeds a predetermined limit. However, such vents are easily opened by manually depressing the pin, thereby subjecting the contents of the tank to the danger of theft. Even with other types of pressure relief vents, it is important to ensure the integrity of the vent by preventing tampering with the vent. Therefore, one embodiment of this invention includes a cover with an enclosure around the vent to prevent tampering while not interfering with the functioning of the pressure relief vent.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings in which:

FIG. 5 is a top view of the cover of the pressure relief vent assembly of the tank assembly;

FIG. 6 is a side view of the pressure relief vent assembly;

DETAILED DESCRIPTION OF THE INVENTION

Figure 1:
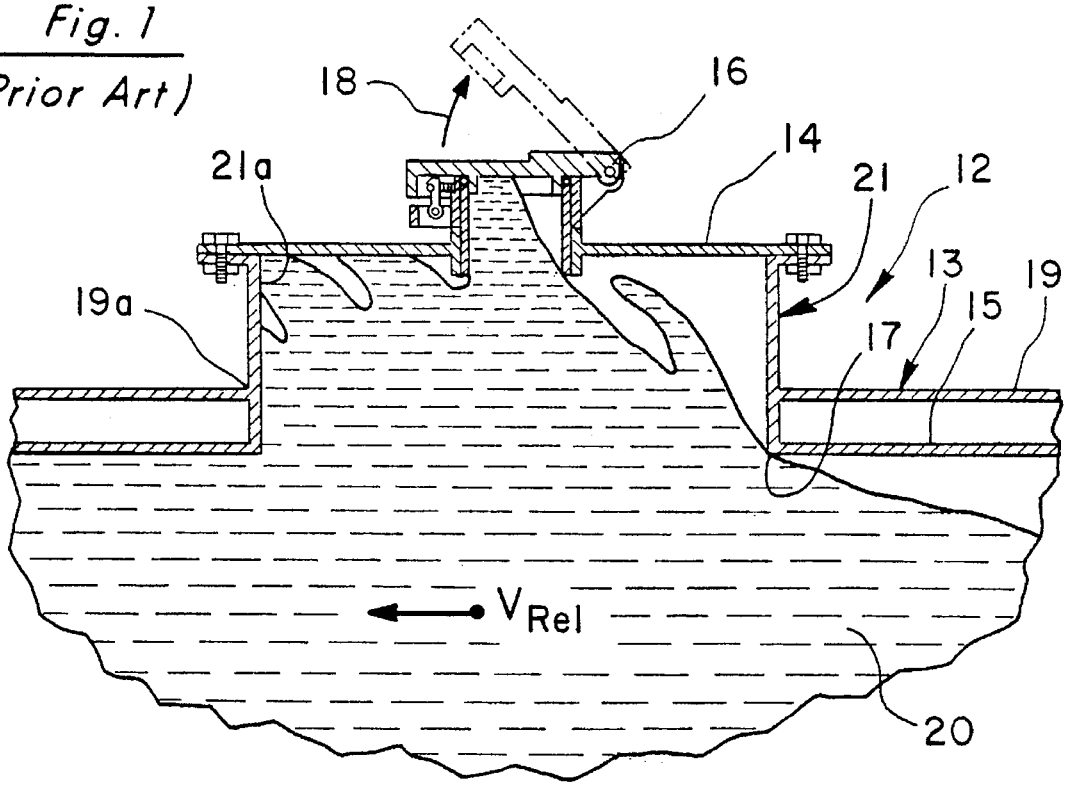
Fig. 1 (Prior Art)
FIG. 1 is a cross sectional view of a prior art double-walled tank containing a surging liquid that is impinging against a pressure relief vent.

Referring now to FIG. 1, a cross sectional view of a double-walled tank 12 of the prior art is shown. The double-walled tank 12 of the prior art has a prior art cover 14 with a pressure relief vent 16 that is designed to move to an open position 18 when the internal pressure of the tank 12 reaches a predetermined limit. The tank 12 contains a liquid 20 that is shown in FIG. 1 surging and impinging against the pressure relief vent 16. Such surging is typically caused by a difference in the velocities of the liquid 20 and the tank 12 (i.e., the relative velocity of the fluid 20 with respect to the tank 12, labeled $V_{Rel}$). The double-walled tank 12 of the prior art has a top portion 13, an inner tank 15 with an opening 17 near the top portion 13, an outer tank 19 surrounding the inner tank 15, the outer tank 19 having an opening 19*a* above the opening 17 of the inner tank 15, and a passageway 21. The passageway 21 extends upward from the opening 17 in the inner tank 15 to at least the opening 19*a* in the outer tank 19. The passageway 21 has an outer opening 21*a*.

When the liquid 20 impinges against the pressure relief vent 16, as shown in FIG. 1, the dynamic pressure of the liquid 20 can cause the vent 16 to move to an open position 18 even though the internal static pressure within the tank 12 has not reached the predetermined limit at which the pressure relief vent 16 is designed to open. Double-walled tanks are typically used for gasoline, fuel oil, and other flammable liquids and hazardous materials, and are often transported on flatbed trucks. A pressure relief vent 16 that opens due to liquid 20 impinging on the pressure relief vent 16 may go unnoticed by the driver of the truck for some time. While unnoticed, a significant volume of flammable liquid could surge out of the tank. In this situation and others, the need for the present invention, which prevents surging liquid held in a double-walled tank from causing the pressure relief vent to open, is particularly acute.

Figure 3:
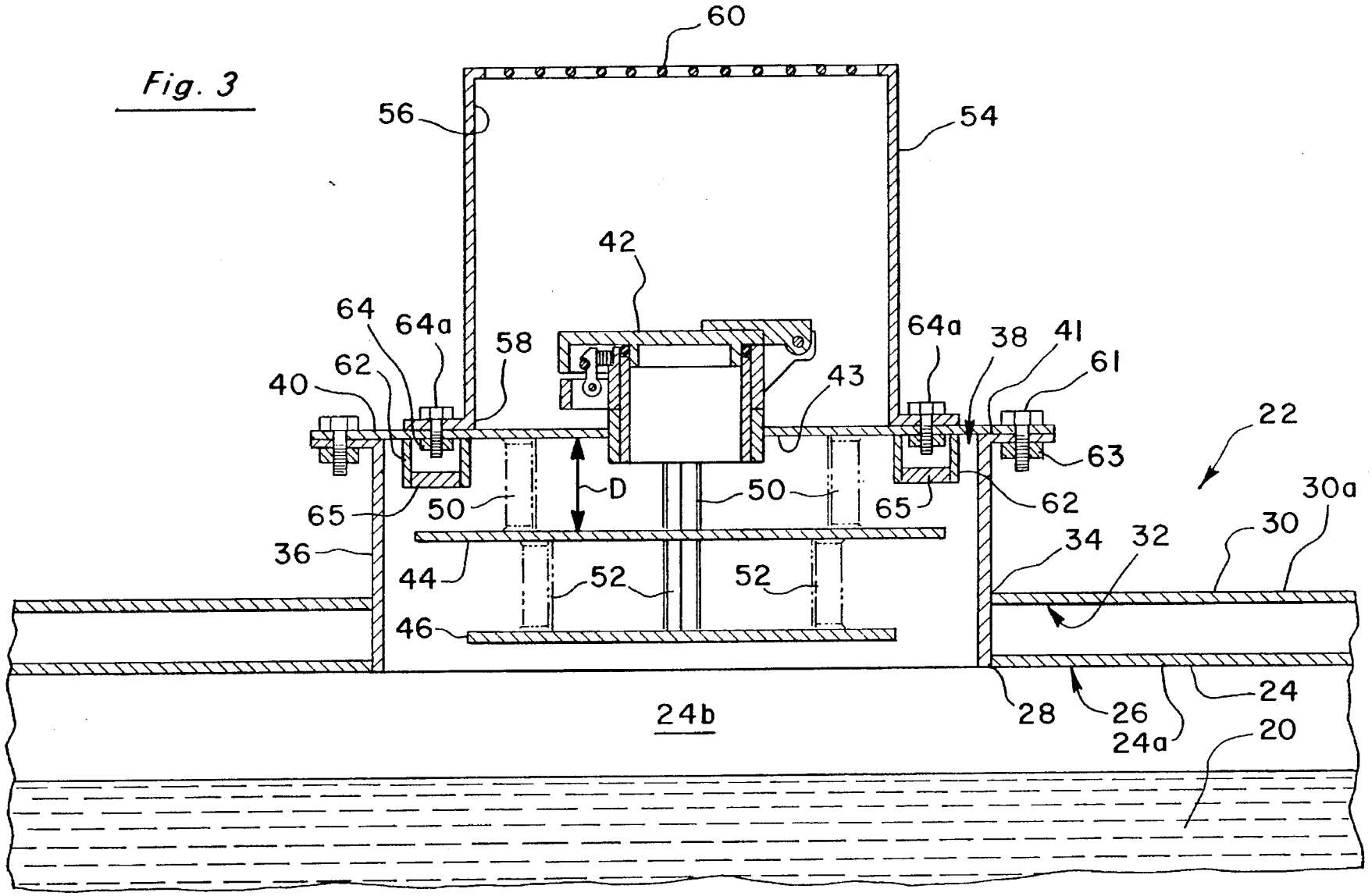
FIG. 3 is a cross-sectional view of the double-walled tank assembly shown in FIG. 2.

The preferred embodiment of the tank assembly 22 of the present invention is shown in FIG. 3. The tank assembly 22 has an inner tank 24 for storing a liquid 20. The inner tank 24 is defined by an interior tank wall 24*a* defining an interior volume 24*b* and has a top portion 26 with an opening 28. An outer tank 30 defined by an exterior wall 30*a* that surrounds the inner tank 24 and is separated by a distance from the interior tank wall 24*a* of the inner tank 24. The exterior wall 30*a* of the outer tank 30 has a top portion 32 with an opening 34. A passageway 36 extends upward from the opening 28 in the top portion 26 of the inner tank 24 to at least the opening 34 in the top portion 32 of the outer tank 30. In this preferred embodiment, the passageway 36 extends above and beyond the opening 34 in the outer tank 30, The passageway 36 has an outer opening 38.

Figure 2:
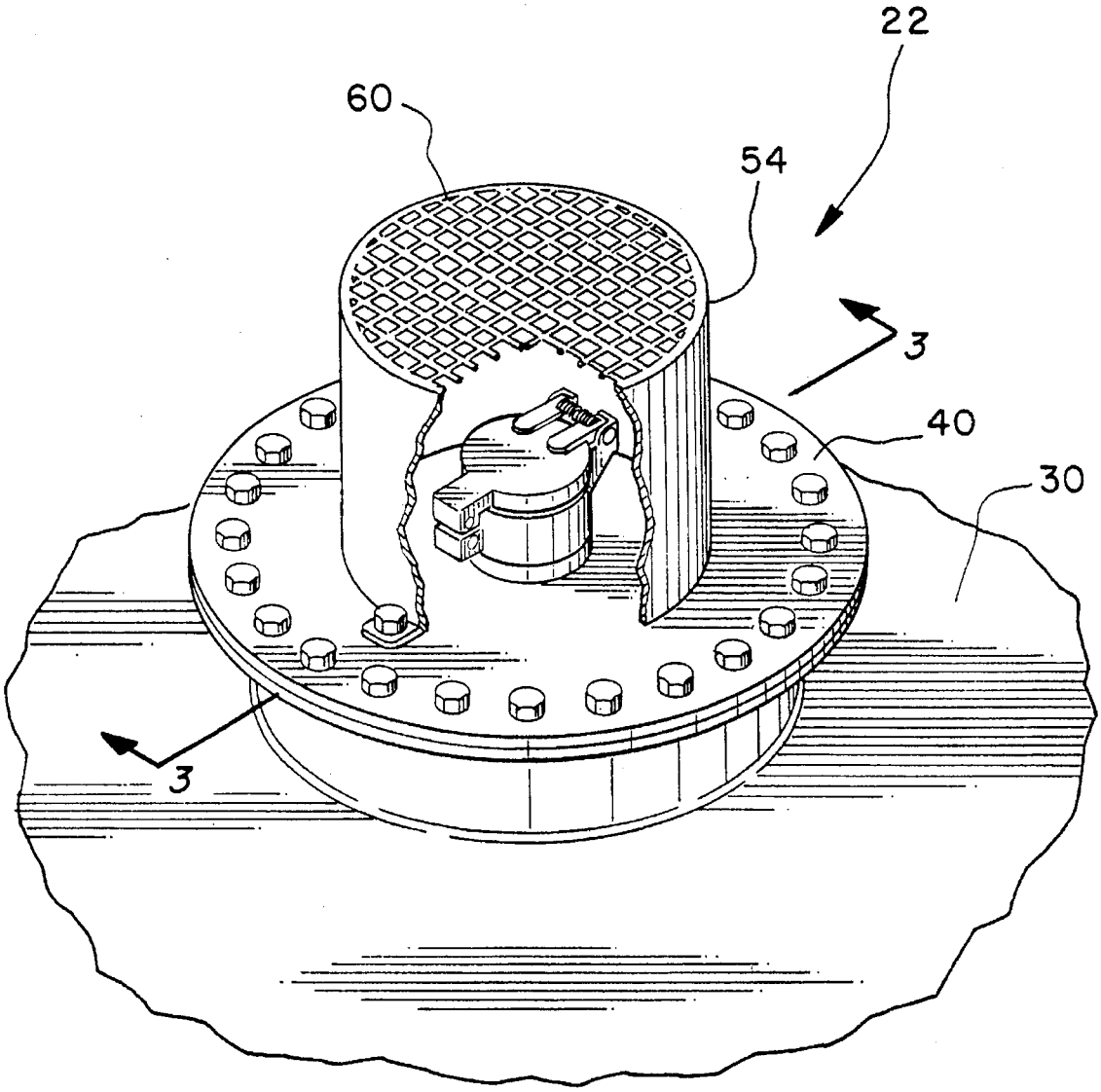
FIG. 2 is a perspective view of a portion of the exterior of the tank assembly of the present invention including the pressure relief vent assembly mounted thereto.
Figure 4:
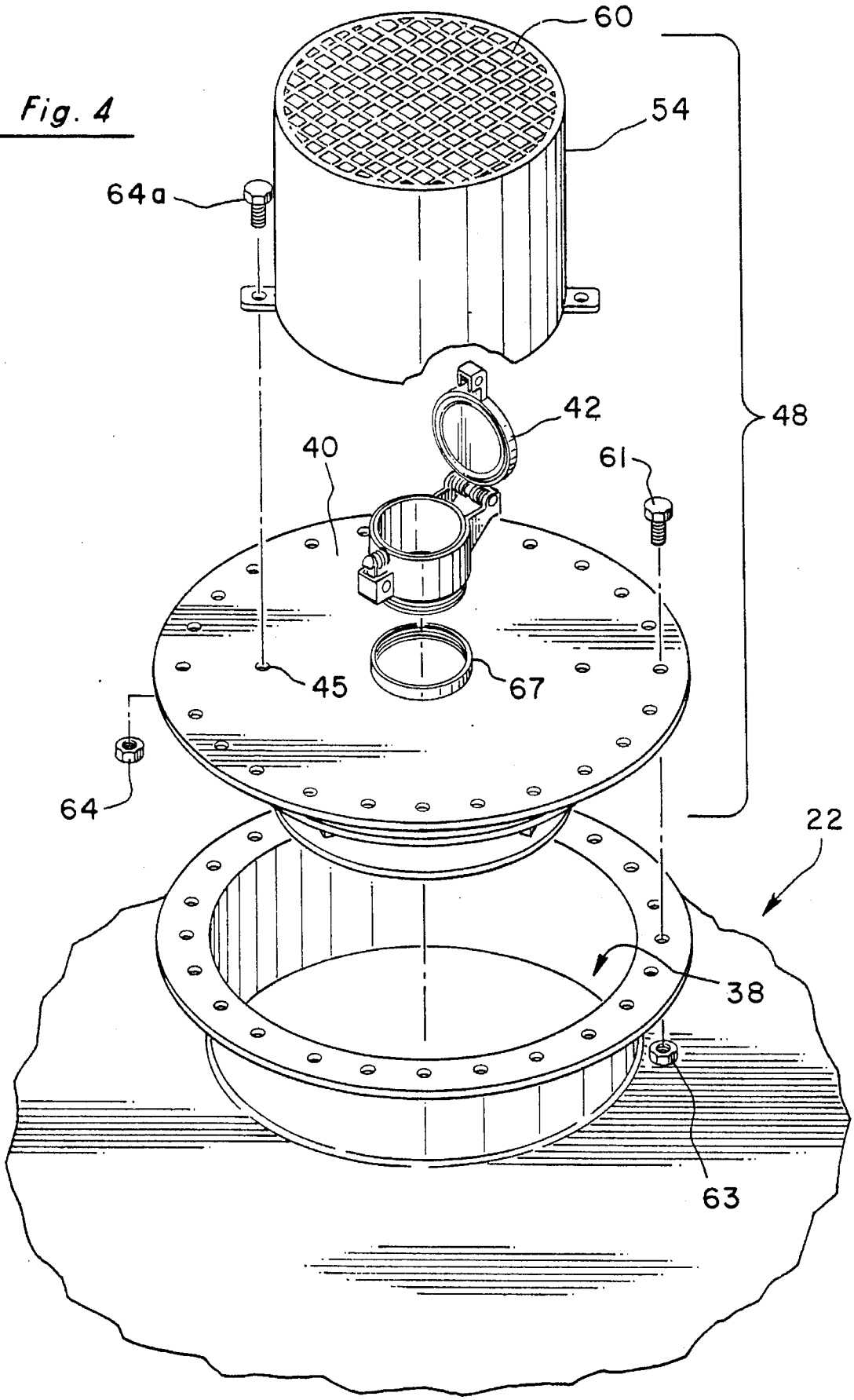
FIG. 4 is an exploded view of the double-walled tank assembly shown in FIG. 2.

As shown in FIG. 4, a pressure relief vent assembly 48 including a cover 40 is mounted over the outer opening 38 of the tank assembly 22. The cover 40 is of a predetermined size larger than the outer opening 38 of the passageway 36. In this preferred embodiment, the cover 40 is removably mounted over the outer opening 38 using stainless steel bolts 61 and nuts 63, thereby removably sealing the outer opening 38 of the passageway 36. The cover 40 has an emergency vent passageway 67. A pressure relief vent 42 is mounted to the cover 40 to block the emergency vent passageway 67 when the pressure relief vent 42 is in a normally closed position (shown in FIG. 3). The pressure relief vent 42 moves from the closed position to an open position (shown in FIG. 4) when the pressure within the inner tank 24 exceeds a predetermined limit. FIG. 2 shows a perspective view of the resulting assembly.

Again referring to FIG. 3, a first plate 44 is suspended from the cover 40 within the passageway 36 at a predetermined distance D below the pressure relief vent 42 and above the top portion 26 of the inner tank 24. The first plate 44 has dimensions smaller than the passageway 36 but sufficiently large to prevent liquid 20 within the inner tank 24 from impinging upon the pressure relief vent 42 during surging. For example, in a tank assembly 22 where the passageway 36 has an inside diameter of 18 inches, the first plate 44 would preferably be about 15 inches in diameter.

The preferred embodiment of the tank assembly shown in FIG. 3 has a second plate 46 suspended at a predetermined distance D2 below the first plate 44 and above the top portion 26 of the inner tank 24. Although plates 44 and 46 are shown as circular in shape, it is to be expressly understood that any shape could be used so long as the plates 44 and 46 are of a size sufficiently smaller than the passageway 36 to prevent the liquid 20 from impinging against the pressure relief vent 42. As shown in the preferred embodiment, the first plate 44 has a substantially planar surface and is mounted to the cover 40 below the emergency vent passageway 67 with the substantially planar surface substantially parallel to the interior surface 43 of the cover 40.

While the tank assembly 22 described above includes the pressure relief vent assembly 48 (shown in FIG. 4), the present invention also includes the pressure relief vent assembly 48 standing alone as a replacement for the prior art cover 14 (shown in FIG. 1) for mounting to the prior art double-walled tank 12 (shown in FIG. 1 ). The pressure relief vent assembly 48 includes the preferred embodiment cover 40, the pressure relief vent 42, the first plate 44, the second plate 46, and the remaining elements described below.

Figure 7:
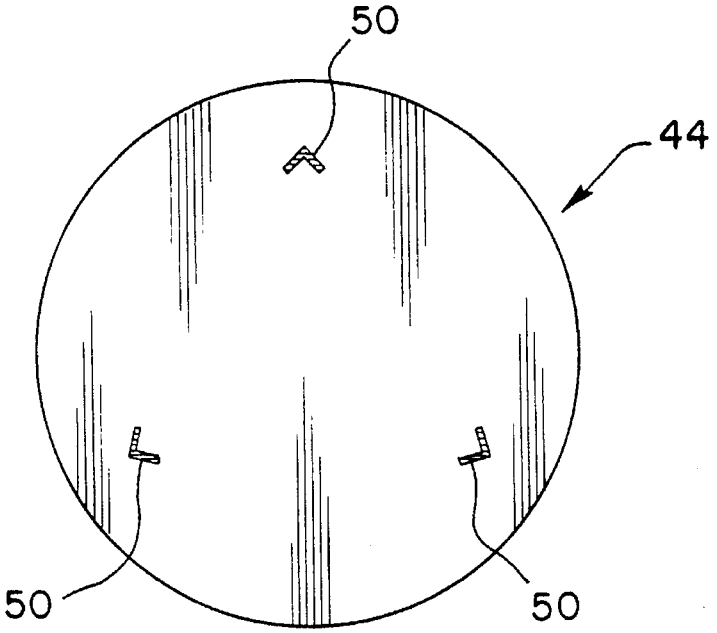
FIG. 7 is a top view of the first plate of the pressure relief vent assembly.
Figure 8:
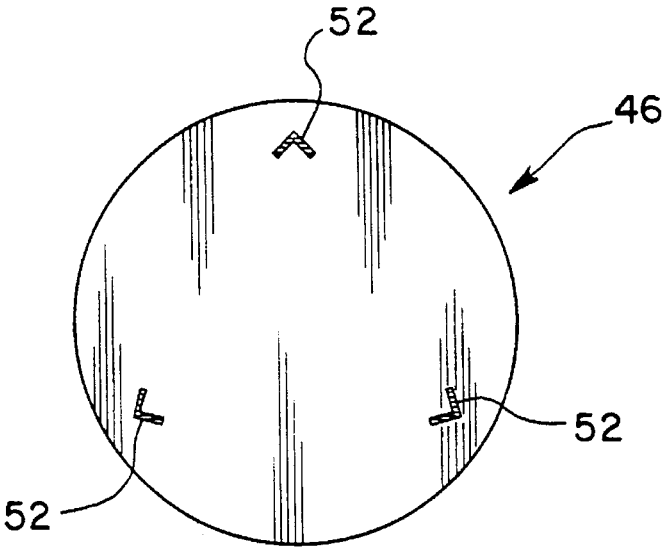
FIG. 8 is a top view of the second plate of the pressure relief vent assembly.

FIG. 5 shows a top view of the preferred embodiment cover 40 of the pressure relief vent assembly 48 having an exterior surface 41, two bolt holes 45, and an interior surface 43 (shown in FIG. 3). FIG. 6 is a side view of the pressure relief vent assembly 48 shown in FIG. 3 (without the pressure relief vent 42, and without the hollow tubular member 54 and top planar member 60 described below). As shown in FIGS. 6 and 7, the first plate 44 is suspended from the cover 40 by three angular members 50 having length D that are attached to the cover 40 and first plate 44 by welding. As shown in FIG. 8, the second plate 46 is smaller in diameter than the first plate 44. The second plate 46 is suspended from the first plate 44 by three angular members 52 of length D2 (shown in FIG. 6).

The pressure relief vent 42 could be subject to tampering. Therefore, to prevent tampering, the pressure relief vent assembly 48 further includes a hollow tubular member 54 (as shown in FIGS. 2, 3, and 4) and a top planar member 60. The hollow tubular member 54 has a top end 56 and a bottom end 58 (shown in FIG. 3). As most clearly shown in FIG. 3, the bottom end 58 is mounted to the exterior surface 41 of the cover 40 over the pressure relief vent 42 to surround the pressure relief vent 42. The top planar member 60 is mounted to the top end 56 of the hollow tubular member 54 by welding. The top planar member 60 of the preferred embodiment is a steel mesh, but could also be any perforated plate. It is important that the enclosure around the pressure relief vent 42 formed by the hollow tubular member 54, the top planar member 60, and the exterior surface 41 of the cover 40 be open to the atmosphere so as to allow venting by the pressure relief vent 42 to the atmosphere.

As shown in FIGS. 3 and 4, the hollow tubular member 54 is mounted to the cover 40 using two conventional stainless steel bolts **64*a* and nuts 64. As shown in FIG. 3, on the interior side 43 of the cover 40 a hollow member 62 is mounted around each bolt hole 45. In the preferred embodiment, the hollow members 62 are formed from steel tubing and are mounted to the cover 40 by welding so as to form a seal. Each hollow member 62 is threaded to receive a plug 65. In assembling, the bolts 64*a* are placed through the bolt holes 45. The nuts 64 are placed on the bolts 64*a* and tightened. Then, the plugs 65 are placed in the hollow members 62 so as to seal the hollow members 62. Thus, the hollow tubular member 54 and top planar member 60 surround and enclose the pressure relief vent 42** and thereby prevent tampering.

Figure 9:
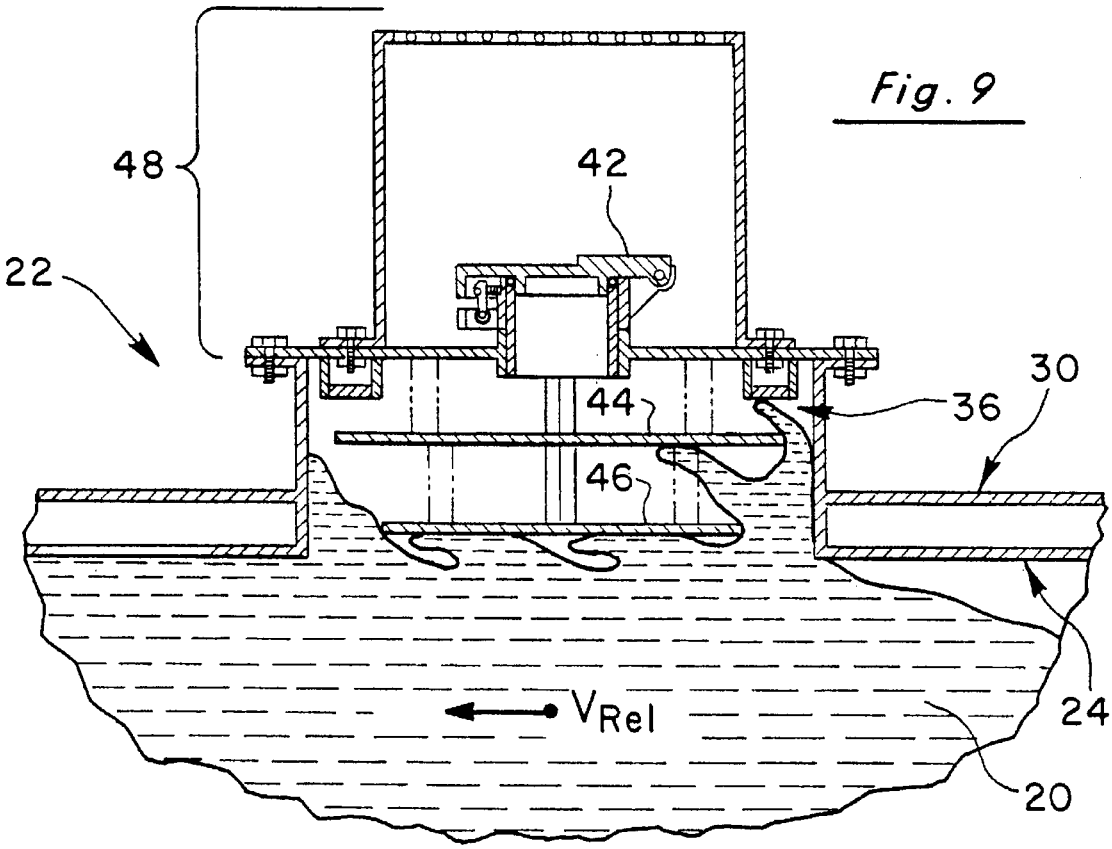
FIG. 9 is a cross-sectional view of the double-walled tank assembly, including the pressure relief vent assembly mounted thereto, preventing surging liquid from impinging against the pressure relief vent.

FIG. 9 shows the tank assembly 22, including the pressure relief vent assembly 48, in use. As shown, the liquid 20 (with relative velocity with respect to the tank assembly 22 of $V_{Rel}$) is surging within the inner tank 24. The surging liquid 20 rises up into the passageway 36, but is prevented from impinging directly against the pressure relief vent 42 by the second plate 46 and the first plate 44, thereby preventing the dynamic pressure of the surging liquid 20 from causing the pressure relief vent 42 to open.

Pressure relief vents typically have an opening with an inside diameter of approximately four inches. The opening is sufficiently large to prevent the tank from exploding if excessive pressure builds up within the inner tank due to combustion, thermal expansion of the liquid, etc. The annular areas remaining between the interior of the passageway 36 and the plates 44, 46 should also be sufficiently large to provide a similar pressure relieving capability. In the preferred embodiment, the annular area around the plates is approximately three or four times larger than the area of the pressure relief vent 42.

It should be understood that the particular embodiments shown in the drawings and described within this specification are for the purpose of example and should not be construed to limit the invention which will be described in the claims below. Now that a number of examples of the apparatus of the invention have been given, numerous other applications should be evident to one skilled in the art. Further, it is evident that those skilled in the art may now make numerous uses and modifications of the specific embodiments described without departing from the inventive concepts disclosed herein. It should be obvious that the various members described may be made from a variety of materials and using a wide combination of dimensions. Consequently, the invention is to be construed as embracing each and every novel feature and novel combination of the features present in or possessed by the apparatus described herein.

I claim:

1. A tank assembly comprising:

an inner tank for storing a liquid, said inner tank having a top portion with an opening;

an outer tank surrounding said inner tank, said outer tank having a top portion with an opening;

a passageway extending upward from said opening in said top portion of said inner tank to at least said opening in said top portion of said outer tank, said passageway having an outer opening;

a cover mounted over said outer opening of said passageway;

a pressure relief vent mounted to said cover, said pressure relief vent opening when pressure within said inner tank exceeds a predetermined limit;

a plate suspended from said cover within said passageway at a predetermined distance below said pressure relief vent and above said top portion of said inner tank, said plate having dimensions sufficiently large to prevent the liquid surging within said inner tank from directly impinging upon said pressure relief vent; and at least a second plate suspended from said plate above said top portion of said inner tank.

2. The tank assembly of claim 1 wherein said passageway extends above said opening in said outer tank.

3. The tank assembly of claim 1 wherein said cover is removable from said outer opening of said passageway.

4. The tank assembly of claim 1 wherein said at least a second plate has a smaller surface area than said plate.

5. The tank assembly of claim 1 further comprising a hollow tubular member having a top end and a bottom end, said bottom end of said hollow tubular member mounted to said exterior surface of said cover and mounted over said pressure relief vent thereby surrounding said pressure relief vent, and a top planar member mounted to said top end of said hollow tubular member, wherein said tubular member and said planar member form an enclosure around said pressure relief vent to prevent tampering with said pressure relief vent.

6. A double-walled tank for storing a liquid therein, said double-walled tank comprising:

an interior wall defining an interior volume, said interior wall having a top portion, said interior wall having an opening near said top portion;

an exterior wall surrounding said interior wall and separated a distance from said interior wall, said exterior wall having an opening above the opening of said interior wall;

a first passageway extending between said openings in said interior and exterior walls, said first passageway having an outer opening;

a cover for removably sealing said outer opening of said first passageway, said cover having an exterior surface and an interior surface, said cover further including an emergency vent passageway between said exterior and interior surfaces;

a pressure relief vent having an open position and a closed position, said pressure relief vent moving from said closed position to said open position in response to a predetermined pressure, said pressure relief vent mounted to said cover to block said emergency vent passageway when said pressure relief vent is in said closed position;

a plate having a substantially planer surface of a predetermined size smaller than said outer opening of said first passageway, said plate mounted within said first passageway suspended from said interior surface of said cover below said emergency vent passageway with said planar surface of said plate being substantially parallel to said interior surface of said cover; and at least a second plate mounted to said plate spaced apart from said plate above said top portion of said inner tank;

wherein when said cover is mounted over said outer opening of said first passageway, the liquid stored in said double-walled tank is prevented from impinging directly against said pressure relief vent by said plate.

7. The double-walled tank of claim 6 wherein said second plate has a smaller surface area than said plate.

8. The double-walled tank of claim 6 further comprising at least one bolt, at least one nut, and a hollow tubular member having a top end and a bottom end, said bottom end having a hole for said bolt, said bottom end of said hollow tubular member mounted by said at least one bolt and said at least one nut to said exterior surface of said cover and mounted over said pressure relief vent, said at least one bolt passing through said at least one hole and through said cover and engaging said at least one nut said hollow tubular member thereby surrounding said pressure relief vent, said tank assembly further comprising a top planar member mounted to said top end of said hollow tubular member, wherein said tubular member and said planar member form an enclosure around said pressure relief vent to prevent tampering with said pressure relief.

9. A pressure relief vent assembly for a double-walled tank with a liquid stored therein, said double-walled tank having a top portion, said double-walled tank having an inner tank, said inner tank having an opening near said top portion, an outer tank surrounding said inner tank, said outer tank having an opening above the opening of said inner tank, a passageway extending upward from the opening in said inner tank to at least the opening in said outer tank, said passageway having an outer opening, said pressure relief vent assembly comprising:

a cover of a predetermined size larger than said outer opening of said first passageway, said cover having an interior surface and an exterior surface;

a pressure relief vent having an open position and a closed position, said pressure relief vent moving from said closed position to said open position in response to a predetermined pressure, said pressure relief vent mounted to said cover;

a first plate of a predetermined size smaller than said passageway, said first plate mounted to said cover spaced apart from said interior surface of said cover and below said pressure relief vent; and a second plate mounted to said first plate spaced apart from said first plate above said top portion of said inner tank;

wherein when said pressure relief vent assembly is mounted to said double-walled tank with the cover over said outer opening of said passageway, said second plate does not extend into said inner tank and the liquid stored in said double-walled tank is prevented from impinging directly against said pressure relief vent by said first plate and said second plate.

10. The pressure relief vent assembly of claim 9 wherein said at least one plate has a substantially planar surface and is mounted to said cover with said substantially planar surface substantially parallel to said interior surface of said cover.

11. The pressure relief vent assembly of claim 9 wherein said at least a second plate has a smaller surface area than said first plate.

12. The pressure relief vent assembly of claim 9 further comprising:

at least one bolt, at least one nut, and a hollow tubular member having a top end and a bottom end, said bottom end having a hole for said bolt, said bottom end of said hollow tubular member mounted by said at least one bolt and said at least one nut to said exterior surface of said cover and mounted over said pressure relief vent, .said at least one bolt passing through said at least one hole and through said cover and engaging said at least one nut, said hollow tubular member thereby surrounding said pressure relief vent, said tank assembly further comprising a top planar member mounted to said top end of said hollow tubular member, wherein said tubular member and said planar member form an enclosure around said pressure relief vent to prevent tampering with said pressure relief vent.

* * * * *